US007438111B2

(12) United States Patent
Grimes et al.

(10) Patent No.: US 7,438,111 B2
(45) Date of Patent: Oct. 21, 2008

(54) STORM CURTAIN WITH COUNTERBALANCE SYSTEM AND DRIVE COMPONENT PROTECTION

(75) Inventors: Darius H. Grimes, Cantonment, FL (US); Stephen J. Borona, Pensacola, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 232 days.

(21) Appl. No.: 11/450,160

(22) Filed: Jun. 9, 2006

(65) Prior Publication Data

US 2007/0284051 A1 Dec. 13, 2007

(51) Int. Cl.
*E04F 10/06* (2006.01)
*A47H 3/00* (2006.01)
*E06B 9/17* (2006.01)

(52) U.S. Cl. ..... 160/23.1; 160/271

(58) Field of Classification Search ..... 160/121.1, 160/133, 22, 23.1, 26, 264, 265, 270, 271, 160/273.1, 275, 290.1, 291, 293.1, 294, 305, 160/31; 242/380, 402, 580, 580.1, 585
See application file for complete search history.

(56) References Cited

U.S. PATENT DOCUMENTS 1,153,015 A * 9/1915 Bauer ..... 160/300
1,952,689 A * 3/1934 Selje ..... 160/275
4,282,919 A * 8/1981 Teno ..... 160/23.1
4,398,585 A * 8/1983 Marlow ..... 160/23.1
4,726,149 A 2/1988 Tryba ..... 49/465
5,465,537 A 11/1995 Fullwood ..... 52/202
5,794,678 A * 8/1998 Beringer et al. ..... 160/41
5,924,468 A 7/1999 Bisconti ..... 160/183
6,296,039 B1 10/2001 Mullet et al. ..... 160/267.1
7,082,981 B2 * 8/2006 Perez, Jr. ..... 160/24
2005/0211389 A1 * 9/2005 Snyder et al. ..... 160/23.1
2007/0193697 A1 * 8/2007 Horvath ..... 160/23.1

* cited by examiner

*Primary Examiner*—Katherine W Mitchell
*Assistant Examiner*—Jeremy C Ramsey
(74) *Attorney, Agent, or Firm*—Renner Kenner Greive Bobak Taylor & Weber

(57) ABSTRACT

A storm curtain assembly (10) includes a fabric curtain (11) which may be wound onto a roll (17) and stored within a canister housing (16) when not in use, and substantially unwound from the roll (17) to cover an opening in a building. When unwound, a lock bar (18) is engaged by the hooks (27) of the lock blocks (21) carried by the housing (16) and by lock tabs (22) carried by the housing (16). The lock tabs (22) extend through slots (28) formed in curtain (11) so as to be able to engage the lock bar (18). As such, the roll (17) and other drive or counterbalance components (15) carried in the housing (16) are protected from any forces on the curtain (11), such forces being absorbed by the housing (16).

19 Claims, 5 Drawing Sheets

STORM CURTAIN WITH COUNTERBALANCE SYSTEM AND DRIVE COMPONENT PROTECTION

TECHNICAL FIELD

This invention relates to a curtain which protects an opening in a building from damage due to high winds and wind borne debris oftentimes present during storm conditions. More specifically, this invention relates to such a curtain which is provided with a system to protect its counterbalance and drive components from damage when the curtain is exposed to such storm conditions.

BACKGROUND ART

In geographic areas which are prone to having high wind events, such as hurricanes and the like, the need exists for the protection of openings, such as windows and doors, in buildings. Otherwise, if the high winds or wind-borne debris breaches the integrity of the structure by destroying a window or door, severe damage to the structure can be expected.

In its most simple form, one type of known protection device which can be utilized is a simple sheet of plywood which can be attached to the structure so as to cover the openings thereof. However, this "boarding up" procedure is not only time consuming, when time is usually of the essence, but also can disfigure the exterior of the structure upon frequent installation and removal. Moreover, storing and maintaining an inventory of plywood sheets can be problematic.

As a result, a number of temporarily installable or permanently installed devices have been developed to be used as alternatives to plywood. For example, metallic shutters consisting of a plurality of hinged slats can be provided adjacent to a window and can be rolled up by a hand crank or a motor when not in use. However, these devices are not only costly, but also they do not provide the necessary seal irrespective of whether they are mounted on the windward or leeward side of the building.

More recently, fabric-based systems have been developed which are much less costly than the metallic shutters or other devices, and which can provide a seal for the openings in the structure. In their simplest form, these systems include a sheet of fabric which is strong enough to withstand high winds and the forces of wind borne debris without rupturing. These fabric sheets may be sealed on all four edges, thus providing a seal for the structure even if the glass of a window, for example, has been broken.

In some such systems, the fabric can be rolled up and stored in a housing or header much like a conventional window shade. These devices usually are provided with a spring-based counterbalance and drive system. A problem associated with these devices is that when the fabric is impacted during a high wind event, the drive or counterbalance system can be damaged, or the fabric curtain can be payed out to an undesired extent, due to the impact of the forces being transferred to the drive or counterbalance components. The result of damage or failure of these components is that repair or replacement thereof must take place before the covering can be operated to open after the passage of the high wind event.

DISCLOSURE OF THE INVENTION

It is thus an object of the present invention to provide a storm curtain in which its drive and counterbalance components are protected from the forces which may be placed on the curtain.

It is a resulting object of the present invention to be able to provide a storm curtain, as above, which can, therefore, be operated by less costly drive and counterbalance components.

It is a further object of the present invention to provide a storm curtain, as above, which is automatically locked at its storage end when it is in the closed position.

These and other objects of the present invention, as well as the advantages thereof over existing prior art forms, which will become apparent from the description to follow, are accomplished by the improvements hereinafter described and claimed.

In general, a storm curtain assembly for covering an opening in a building made in accordance with one aspect of the invention includes a roll which is rotatable within a housing. A curtain has one end attached to the roll and is adapted to be wound onto the roll for storage and substantially off of the roll to cover the opening. At least one lock block is carried by the housing to engage the lock bar when the curtain is wound substantially off the roll to cover the opening.

In accordance with another aspect of the invention, the storm curtain assembly includes a roll which is rotatable within a housing. A curtain has one end attached to the roll and is adapted to be wound onto the roll for storage and substantially off of the roll to cover the opening. A plurality of spaced lock tabs are carried by the housing. The curtain has an opening for each lock tab so that the lock tabs may extend through the openings and engage the lock bar when the curtain is wound substantially off the roll to cover the opening.

A preferred exemplary storage curtain assembly according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
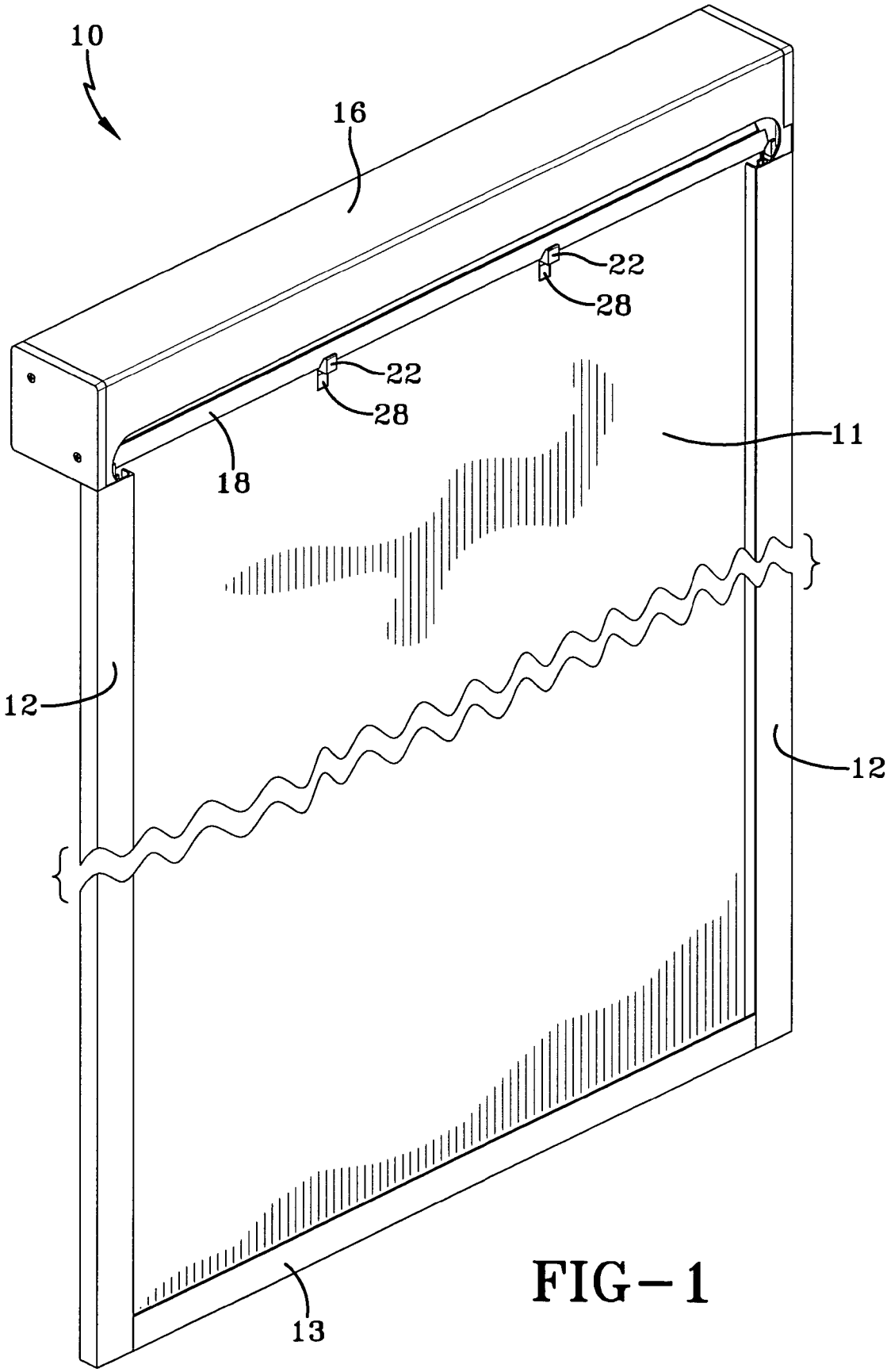
FIG. 1 is fragmented perspective view of a storm curtain assembly made in accordance with the present invention shown in the fully extended, locked, closed position.

A storm curtain assembly made in accordance with the present invention is indicated generally by the numeral 10. Storm curtain assembly 10 may be mounted on the inside of a structure adjacent to a window or other opening in the structure to protect the structure from pressure differentials if, for example, the window were to break during a storm. Alternatively, storm curtain assembly 10 may be mounted on the outside of the structure to cover the window or other opening to protect it from being ruptured. To that end, assembly 10 includes a protective curtain 11 which is preferably made of a fabric material which can withstand the forces of wind and airborne debris as are often encountered in a hurricane or the like. Exemplarily fabric for such a curtain 11 is disclosed in U.S. patent application Ser. No. 11/190,114 filed on Jul. 25, 2005, to which reference is made for whatever details may be necessary to understand the present invention.

Curtain 11 is moveable between side rails 12 of curtain assembly 10, and may be locked into a bottom sill 13. Such locking can be accomplished by a latch bar mechanism 14 carried at the bottom of curtain 11 and schematically shown in FIGS. 5-8. One manner in which curtain 11 slides along side rails 12 and its ability to lock to sill 13 is described in U.S. Pat. No. 6,959,748 to which reference is made, as necessary, for a complete understanding of such features.

Curtain assembly 10 also includes drive/counterbalance components somewhat schematically shown and generally indicated by the numeral 15. Components 15 are housed in a canister housing 16 and include a storage roll 17 and other components (not shown) such as springs, gears and the like which are part of a counterbalance system such as shown in U.S. Pat. No. 6,959,748 to which reference is made for whatever details are necessary to understand components 15 of curtain assembly 10. Storage roll 17 is rotatably mounted in housing 16 and may be manually operated or may be automatically operated by drive components, such as a motor and motor controls, which can be positioned within canister housing 16, as is known by one skilled in the art.

The upper end of curtain 11, opposite to the end carrying bar 14, is attached to roll 17 so that curtain 11 can be wound onto, and off of, roll 17. Curtain 11 carries a lock bar 18 near the upper end thereof. As shown, lock bar 18 extends laterally across curtain 11 to a lateral extent longer than curtain 11 so as to have an overhang portion 19 extending outwardly from each lateral edge of curtain 11. Lock bar 18 may be made of any suitable rigid material, typically a metallic material, and can be attached to curtain 11 by any suitable means. For example, lock bar 18 may be glued to curtain 11 or may be sandwiched between two layers of curtain material which are then stitched to hold bar 18 in place.

As a result, when curtain 11 is wound up onto roll 17, lock bar 18 is likewise positioned on roll 17. So as to not take up any additional space when so positioned, a circumferential pocket 20, shown in FIGS. 4-7, is formed in roll 17 to receive lock bar 18. In order for lock bar 18 to be properly received in pocket 20, it too preferably takes on a slightly curved shape generally corresponding to the circumferential curvature of pocket 20.

Canister housing 16 carries a lock block, generally indicated by the numeral 21, near each end thereof. Each lock block 21 is positioned laterally outside of the lateral edge of curtain 11. Canister housing 16 also carries a plurality (two shown) of laterally spaced lock tabs 22. Although two such tabs 22 are shown, it should be evident that any number of laterally spaced lock tabs 22 could be provided in accordance with this invention.

Figure 3:
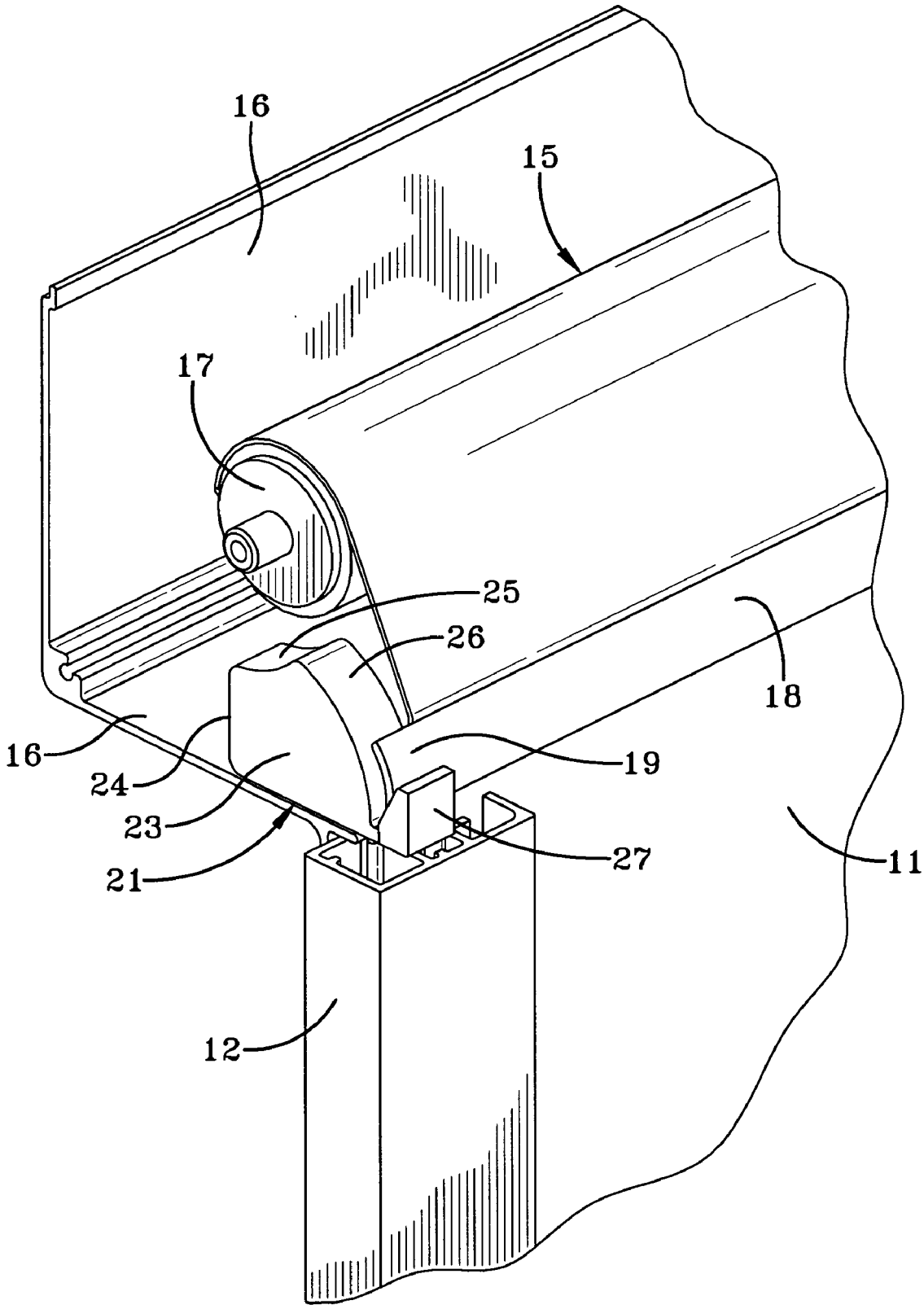
FIG. 3 is an enlarged fragmented view of a portion of the curtain assembly of FIG. 2.
Figure 4:
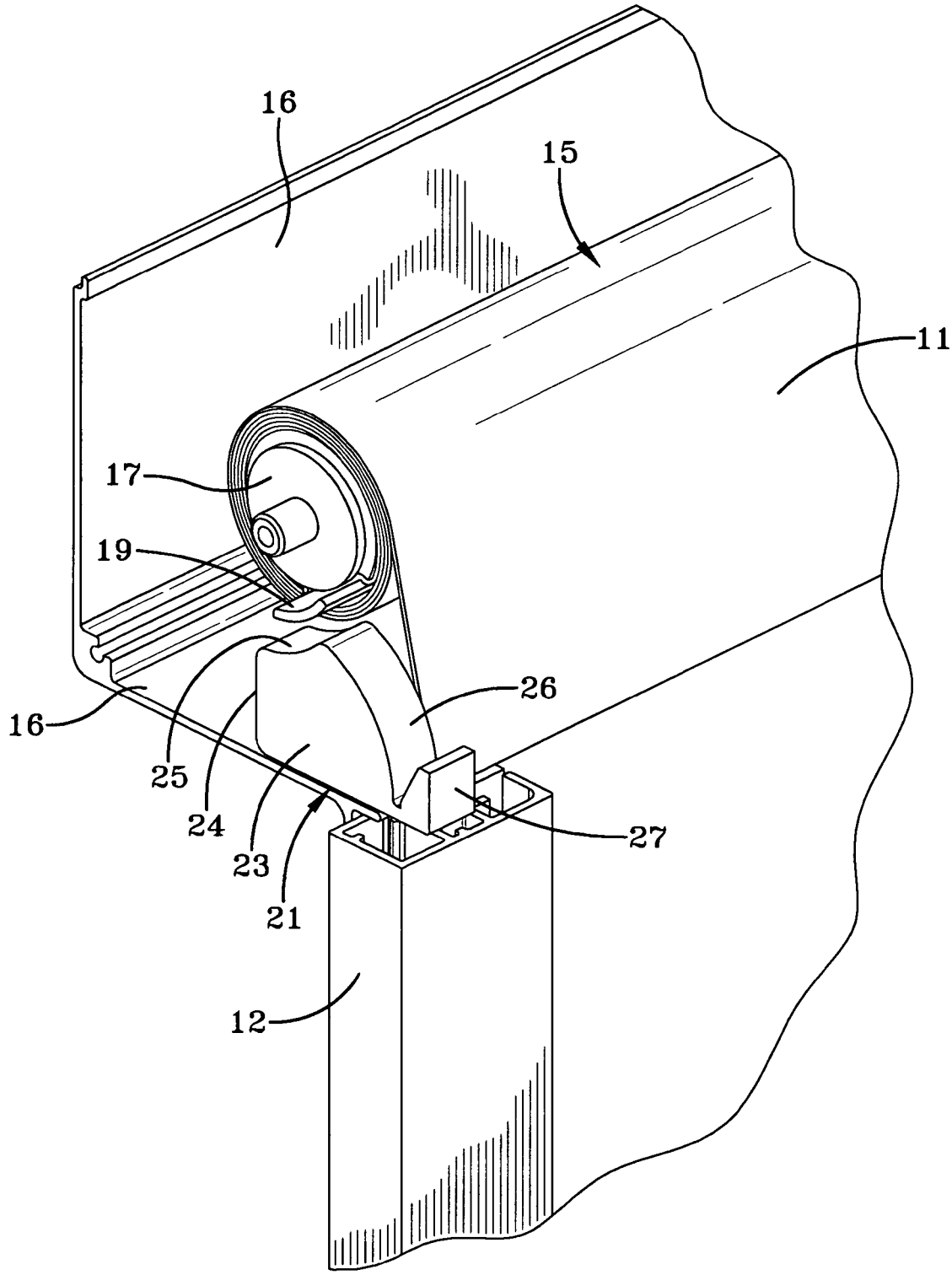
FIG. 4 is a view similar to FIG. 3 but showing the condition of the curtain assembly as it is being lowered.

As best shown in FIGS. 3 and 4, each lock block 21 includes a body portion 23 extending upwardly from the bottom surface of canister housing 16. Body portion 23 has a generally vertical back wall 24, a dished-out or concave top wall 25, and an arcuate, convex front wall 26 extending downwardly from top wall 25. The bottom end of front wall 26 carries a lock hook 27 extending outwardly therefrom, forwardly above each side rail 12. As will now be described, lock hooks 27 are positioned to engage the overhang portions 19 of lock bar 18.

Figures 5, 6, 7, 8:
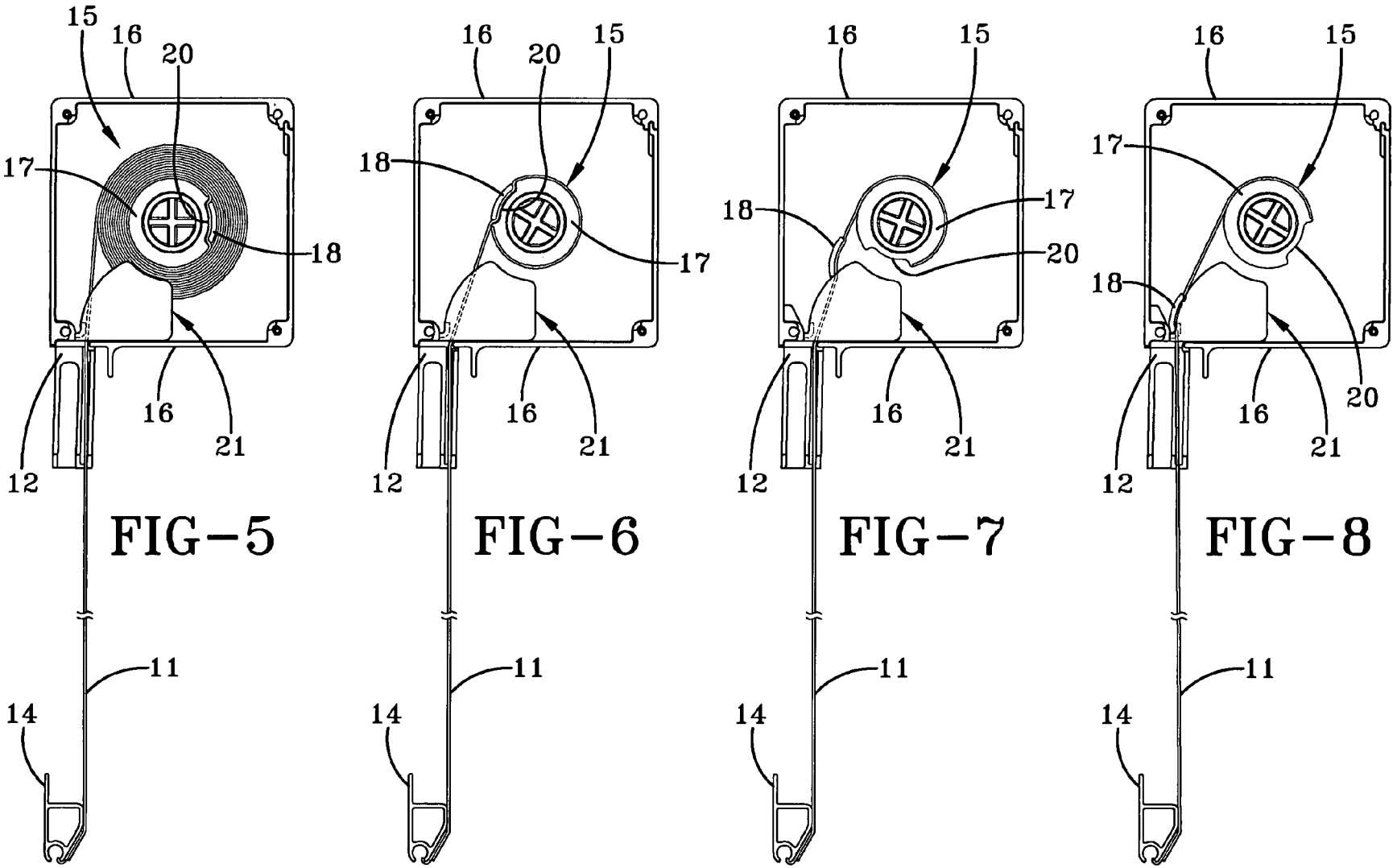
FIG. 5 is a schematic view showing the curtain assembly almost fully coiled within the housing for the counterbalance components.
FIG. 6 is a schematic view sequentially following FIG. 5 and showing the curtain assembly nearing its fully closed position.
FIG. 7 is a schematic view sequentially following FIG. 6.
FIG. 8 is a schematic view sequentially following FIG. 7 and showing the curtain assembly in the fully closed, locked position.

The manner in which curtain assembly 10 operates to protect the drive/counterbalance components 15 within canister housing 16 is best described with reference to the somewhat schematic sequential views of FIGS. 5-8. FIG. 5 shows the condition of curtain assembly 10 when curtain 11 is just starting to be withdrawn from roll 17. As such, the vast majority of curtain 11 is on roll 17, but as previously described, the fact that lock bar 18 is carried by curtain 11 does not take up any additional space as lock bar 18 is recessed within pocket 20.

As the curtain 11 is being withdrawn, lock blocks 21 do not interfere with the overhang portions 19 of lock bar 18. As shown in FIG. 4, as roll 17 rotates, the concave top surface of lock blocks 21 provides clearance so that lock bar 18 does not engage lock blocks 21.

Figure 2:
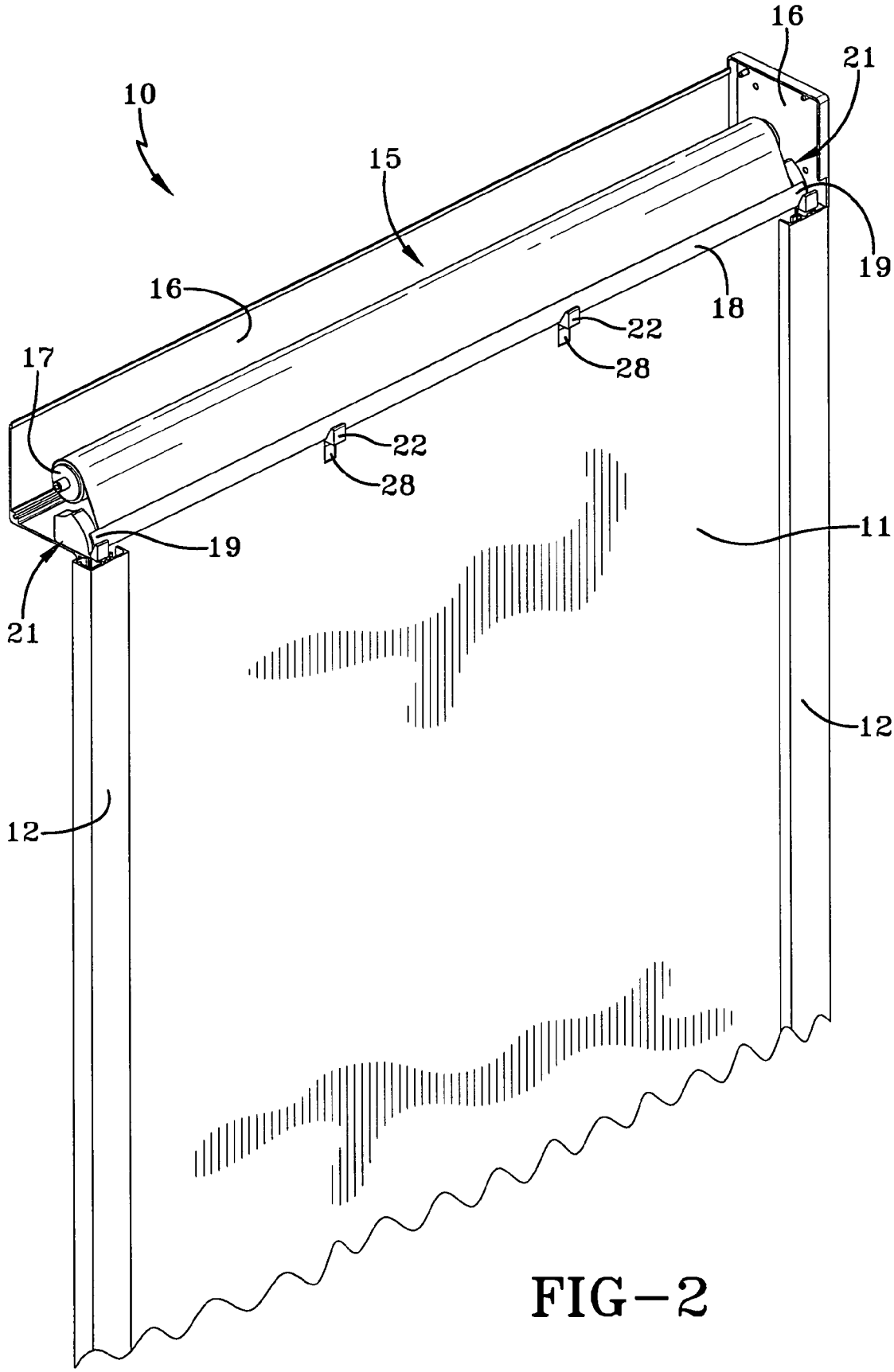
FIG. 2 is a partial fragmented view of the curtain assembly of FIG. 1 showing the housing for the counterbalance components open and the curtain assembly in the closed position.

FIG. 6 represents the condition where curtain 11 is approaching its fully down position with lock bar 18 being in a position to leave pocket 20 of roll 17. As shown in FIG. 7, continued downward movement of curtain 11 causes overhang portions 19 of lock bar 18 to engage arcuate front wall 26 of lock blocks 21 from which point overhang portions 19 are guided into the lock hooks 27 of lock blocks 21 as shown in FIG. 8, and FIGS. 2 and 3 as well. As this is occurring, openings in the form of slots 28 formed at the appropriate locations in curtain 11 create the clearance necessary so that lock tabs 22 can pass therethrough and engage lock bar 18 as shown in FIGS. 1 and 2.

With curtain 11 in the fully closed position, and with lock bar 18 being fully engaged by lock hooks 27 and lock tabs 22, stresses placed on curtain 11 which might be created by impacts from wind borne debris or high velocity wind itself, are transmitted to the structure of the storage canister housing 16 rather than roll 17 and the other drive components 15. As such, the drive components remain fully protected, thereby accomplishing the objects of the present invention and otherwise substantially improving the art.

What is claimed is:

1. A storm curtain assembly for covering an opening in a building comprising a housing, a roll rotatable in said housing, a curtain having one end attached to said roll and adapted to be wound onto said roll in a first direction for storage and substantially off of said roll in a second direction to cover the opening, a lock bar carried by said curtain near said one end, and at least one lock block carried by said housing, said lock block engaging said lock bar when said curtain is wound substantially off said roll to cover the opening to prevent further movement of said roll in the second direction and at least one lock tab carried by said housing, said curtain having an opening to receive said lock tab therethough so that said lock tab engages said lock bar.

2. The storm curtain of claim 1 wherein said lock bar includes an overhang portion extending laterally outwardly from said curtain at each lateral end thereof, there being a said lock block positioned to engage each said overhang portion of said lock bar.

3. The storm curtain of claim 2 wherein said lock blocks include a concave upper surface to provide clearance for said overhang portions when said lock bar is on said roll.

4. The storm curtain of claim 1, said lock block including a lock hook to engage said lock bar.

5. The storm curtain of claim 4, said lock block including a convex wall to direct said lock bar into said lock hook.

6. The storm curtain of claim 1 further comprising a pocket formed in said roll, said lock bar being received in said pocket when said curtain is wound on said roll.

7. The storm curtain of claim 6, said lock bar being curved, said curve generally corresponding to the curve of the circumference of said roll.

8. A storm curtain assembly for covering an opening in a building comprising a housing, a roll rotatable in said housing, a curtain having one end attached to said roll and adapted to be wound onto said roll in a first direction for storage and substantially off of said roll in a second direction to cover the opening, a lock bar carried by said curtain near said one end, and a plurality of spaced lock tabs carried by said housing, said curtain having an opening for each said lock tab so that said lock tabs extend through said openings and engage said lock bar when said curtain is wound substantially off said roll to cover the opening to prevent further movement of said roll in the second direction.

9. The storm curtain of claim 8 further comprising a lock block carried by said housing at each lateral edge of said curtain, said lock blocks engaging said lock bar when said curtain is wound substantially off said roll to cover the opening.

10. The storm curtain of claim 9 wherein said lock bar includes an overhang portion extending laterally outwardly from said curtain at each lateral edge thereof, said lock blocks engaging said overhang portions of said lock bar.

11. The storm curtain of claim 10 wherein said lock blocks include a concave upper surface to provide clearance for said overhang portions when said lock bar is on said roll.

12. The storm curtain of claim 9, each said lock block including a lock hook to engage said lock bar.

13. The storm curtain of claim 12, each said lock block including a convex wall to direct said lock bar into said lock hook.

14. The storm curtain of claim 8 further comprising a pocket formed in said roll, said lock bar being received in said pocket when said curtain is wound on said roll.

15. The storm curtain of claim 14, said lock bar being curved, said curve generally corresponding to the curve of the circumference of said roll.

16. A storm curtain assembly for covering an opening in a building comprising a housing, a roll rotatable in said housing, opposed side rails extending from said housing, a fabric curtain having one end attached to said roll and adapted to be wound onto said roll for storage and substantially off of said roll to cover the opening in the building by moving between said side rails, a lock bar carried by said curtain near said one end, at least one lock block carried by said housing, and a plurality of spaced lock tabs carried by said housing, said curtain having an opening in the fabric for each said lock tab so that said lock tabs extend through said openings and engage said lock bar when said curtain is wound substantially off said roll to cover the opening in the building, said lock block at the same time engaging said lock bar.

17. The storm curtain of claim 16 wherein said lock bar includes an overhang portion extending laterally outwardly from said curtain at each lateral end thereof, there being a said lock block positioned to engage each said overhang portion of said lock bar.

18. The storm curtain of claim 17, each said lock block having a concave upper surface to provide clearance for said overhang portions when said lock bar is on said roll, a lock hook to engage said lock bar, and a convex wall to direct said lock bar into said lock hook.

19. The curtain of claim 16 further comprising a pocket formed in said roll, said lock bar being arcuate and having a curve generally corresponding to the curve of the circumference of said roll so that said lock bar can be received in said pocket when said curtain is wound on said roll.

* * * * *